United States Patent [19]

Allen

[11] 4,256,953

[45] Mar. 17, 1981

[54] CYCLE INCREMENT DURATION MEASURING AND DISPLAY UNIT

[75] Inventor: Paul E. Allen, Newtown, Conn.

[73] Assignee: Logic Devices, Inc., Bethel, Conn.

[21] Appl. No.: 956,511

[22] Filed: Oct. 31, 1978

[51] Int. Cl.[3] ..... G06G 7/00

[52] U.S. Cl. ..... 235/92 T; 235/92 PD

[58] Field of Search ..... 235/92 T, 92 PD; 364/552, 569

[56] References Cited

U.S. PATENT DOCUMENTS

| | | | |
|---|---|---|---|
| 3,670,147 | 6/1972 | Wright | 235/92 T |
| 4,038,617 | 7/1977 | Milom | 235/92 PD |
| 4,071,892 | 1/1978 | Genzling | 235/92 T |
| 4,074,117 | 2/1978 | Delorean et al. | 235/92 T |
| 4,075,829 | 2/1978 | Goff | 235/92 T |
| 4,109,140 | 8/1978 | Etra | 235/92 T |
| 4,142,238 | 2/1979 | Brandt et al. | 235/92 T |

*Primary Examiner*—Leo H. Boudreau
*Attorney, Agent, or Firm*—Thomas L. Tully

[57] ABSTRACT

An apparatus for motivating an operator's performance by measuring the durations in a plural step repeating work cycle of a machine of at least a step whose duration is mostly controlled by an operator and displaying for the operator's observation the duration of the immediately prior step, the average duration of said operator's steps from the beginning of a work period, the average of all operator's steps, a standard predetermined duration of the step and the maximum duration of the step that is added to the average together with displaying at least some of the same durations for at least one or more other steps performed during the cycle and/or of the complete cycle together with the number of down or non-operating occurrences and the elapsed time thereof.

17 Claims, 8 Drawing Figures

CYCLE INCREMENT DURATION MEASURING AND DISPLAY UNIT

Many machines follow a repeating work cycle with each cycle having a plurality of different steps whose durations are controlled by adjustments to the machine and at least one step which requires an act to be performed by an operator. The steps controlled by the machine are generally fixed in duration in accordance with the reaction of the machine and the product made while the duration of the one step that requires activity by an operator is essentially set by the skill and attention of the operator. Thus, in such a work cycle, increased productivity by reducing the total cycle time is attainable generally only by reducing the duration of the operator activity as this tends to be the most variable of the durations.

While it has heretofore been suggested that various measurements be made of the total cycle as to the duration of the last cycle, the number of cycles and the average cycle duration, such information has been for management's use rather than being displayed for the operator's observation. However, no attempt has heretofore been made to specifically render the operator aware of the duration of the operator activity step in each work cycle for the immediately completed cycle together with facilitating comparisions thereof with the average duration of the same step for a plurality of cycles. Additionally, no attempt has been heretofore made to enable an operator to compare a shift average time with the average time of all operator's that have performed the same act.

One such work cycle occurs in a plastic injection molding machine when the cycle for producing an article broadly has the three steps of (1) a closing step which is initiated by the operator and which closes the mold dies, (2) a clamp step which maintains the dies closed while plastic material is injected and then somewhat hardened and (3) an open step which includes the opening of the mold dies and an operator act such as the removing of the hardened article from the mold dies and perhaps placing an insert into the mold dies for the next cycle. While the durations of the first and second steps are basically set by the machine and product variables, the attention and/or non-readiness of the operator to initiate performance of the operator act plus perhaps slowness in its performance, has basically set the duration of the third step. Moreover, of the three steps, the third step is the most apt to have the most variation and be the only step which is susceptible to having its duration reduced to reduce the total cycle time of the machine.

It is accordingly an object of the present invention to provide a measuring unit that measures the duration of at least the step that includes the operator controlled act and displays it for observation by the operator is made immediately aware of information of the duration of this step and becomes motivated during each cycle to maintain a minimum duration.

Another object of the present invention is to achieve the above object together with displaying for the operator's observation and motivation, the average of each of the durations of each operator activity step from the beginning of a work period and for a plurality of work periods whereby an operator may compare the duration of a just completed step with the average durations of the operator's own previous same steps and all operator's previous steps.

A further object of the present invention is to achieve the above objects with a unit and method that prevents distortion of the average of the operator's activity step by machine stop-pages that are not attributable to the operator'performance.

Still another object of the present invention is to provide a measuring and display unit and method that measures and displays the durations for at least two different steps in a plural step repeating work cycle with the display indicating the duration of each step in the just completed cycle, the average duration for each step from the beginning of a work period and a standard predetermined duration for each step.

In carrying out the present invention, it is herein disclosed specifically applied to a plastic injection molding machine wherein one complete work cycle for producing a molded article includes three distinct steps, the close step of closing the mold dies until the clamp step begins, the clamp step of maintaining the mold dies clamped together while injecting and cooling plastic material and the step of opening the mold dies which includes the operator act of removing the molded article, preparing the dies for the next cycle (which may include a placing of an insert in the opened dies) and then the initiation of the next work cycle.

The present invention measures the duration of the open step which is basically set by the time required by the operator to perform its activity and displays this duration immediately for the operator's observation. Also displayed for the operator's observation and comparison are the average duration of the open steps both from when the operator began a work period and the average of all operator acts since the same activity began so that an operator may have both an individual and a peer comparison. Further displayed are a predetermined or standard duration of the open step and a maximum open step duration which, if exceeded, is generally caused by events beyond the operator's control and the excess of time over this maximum is prevented from being included in the open step average durations. Thus, the open step average times are not penalized by events beyond the control of the operator.

It has also been found advantageous, both in monitoring the present operation of a machine and also in initially setting up the machine to perform its machine controlled steps, to display a standard duration, a present cycle duration, and an average cycle duration of at least one machine controlled step, such as the close step and further, to maintain identical durations for the complete work cycle. The clamp step duration may be easily obtained by substraction of the sum of the durations of the other two steps from the total cycle duration if it is not determinable from components of the machine. These displayed durations serve to motivate other workers involved with the machine, such as foremen or set-up men, to duplicate prior satisfactory cycle times when the same work cycles are subsequently repeated.

Other features and advantages will hereinafter appear.

Figure 2:
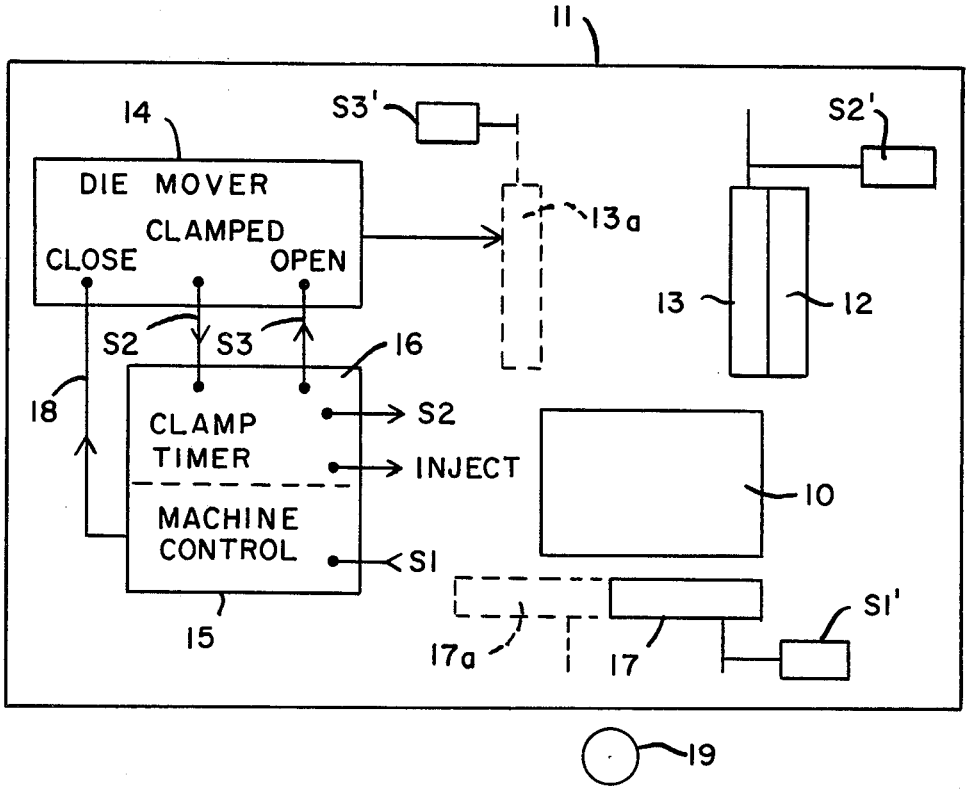
FIG. 2 is a diagrammatic representation of a plastic molding machine having the unit mounted thereof.

Referring to the drawings, the measuring and display unit of the present invention is generally indicated by the reference numeral 10 and is shown in FIG. 2 within a solid line block 11. The block 11 is representative of a plastic injection molding machine that has a stationary die 12 and a movable die 13 and the unit 10 is shown within the block 11 as it is preferably mounted on the machine. The die 13 is movable from its solid line position wherein it is forced or clamped against the stationary die 12 to an open position, such as indicated by the dotted line 13*a*, by use of a die mover block 14. The machine 11 further includes a machine control block 15 which includes a clamp timer 16 which is settable to the desired duration of the clamp step. In addition, such a molding machine further includes a safety gate 17 movable between its solid line closed position and a dotted line open position 17*a* to enable an operator to have access to the mold dies.

In the operation of the molding machine 11 to produce a molded article, and operator initiates a work cycle by causing the gate 17 to close which provides an electrical signal S1 to the machine control block 15. If such a signal is not available in the machine, then a switcch S1' may be employed to be actuated when the gate attains its closed position by being mounted in the position shown. The S1 signal to the machine control block 15 produces a close signal on a lead 18 to the die mover block 14 which causes the die 13 to be moved from its open position 13*a* to its closed position 13.

The die mover block 14 produces a signal S2 to the clamp timer 16 when the dies are ready for plastic material injection and if such a signal is not readily available, a somewhat satisfactory signal may be obtained from a switch S2' which is mounted on the machine to be actuated by the movable die 13 attaining its closed position. The dies 12 and 13 remain clamped in a closed position for the duration to which the adjustable clamp timer 16 is set and during this time, plastic material is injected into the mold cavity. After the expiration of the timer 16 time, the timer passes an open signal S3 to the die mover block 14 to cause the die 13 to be automatically moved to its open position 13*a* whereat it actuates the switch S3'. The operator, upon the switch S3' being actuated assumes a position in an area 19 adjacent the open gate 17*a*, removes the finished article from the mold dies and may or may not put an insert into the mold die 12 and then closes the gate or otherwise produces the signal S1 to initiate the next work cycle. While the machine is functioning to produce its machine controlled steps of the cycle, the operator may be performing other steps such as supplying and servicing the injection molding machine 11 and/or the finished articles.

Figure 3:
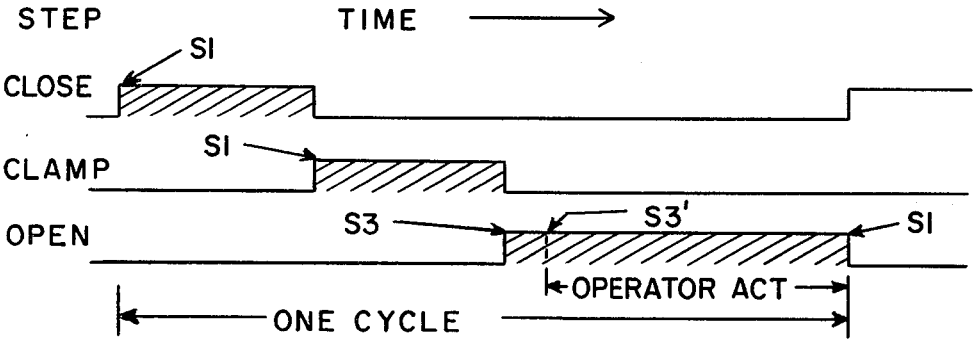
FIG. 3 is a diagram of the relative durations in a work cycle of the machine.

The duration between the producing of the S1 signal and the producing of the S2 signal by the movable die leaving the open position to assume the closed clamp position is the time for the close step as indicated in FIG. 3. The clamp step duration is set by the timer 16 to be independent of the operator and it terminates with the occurrence of the S3 signal. The duration from the S3 signal until the occurrence of the S1 signal is referred to as the open step. The duration of the complete cycle from the time signal S1 is produced until it is produced again constitutes the duration of one work cycle.

It will be noted that the open step duration includes both the time that is required for the die 13 to move from its clamped position to its open position and the time for the operator act of servicing the machine and after such servicing, cause production of the S1 signal. The former time is basically set by the machine control 14 and is generally quite short compared to operator activity time. Further, the latter is basically defined by the signal S3' which is produced while the switch S3' is closed by the movable die 13.

Figure 1:
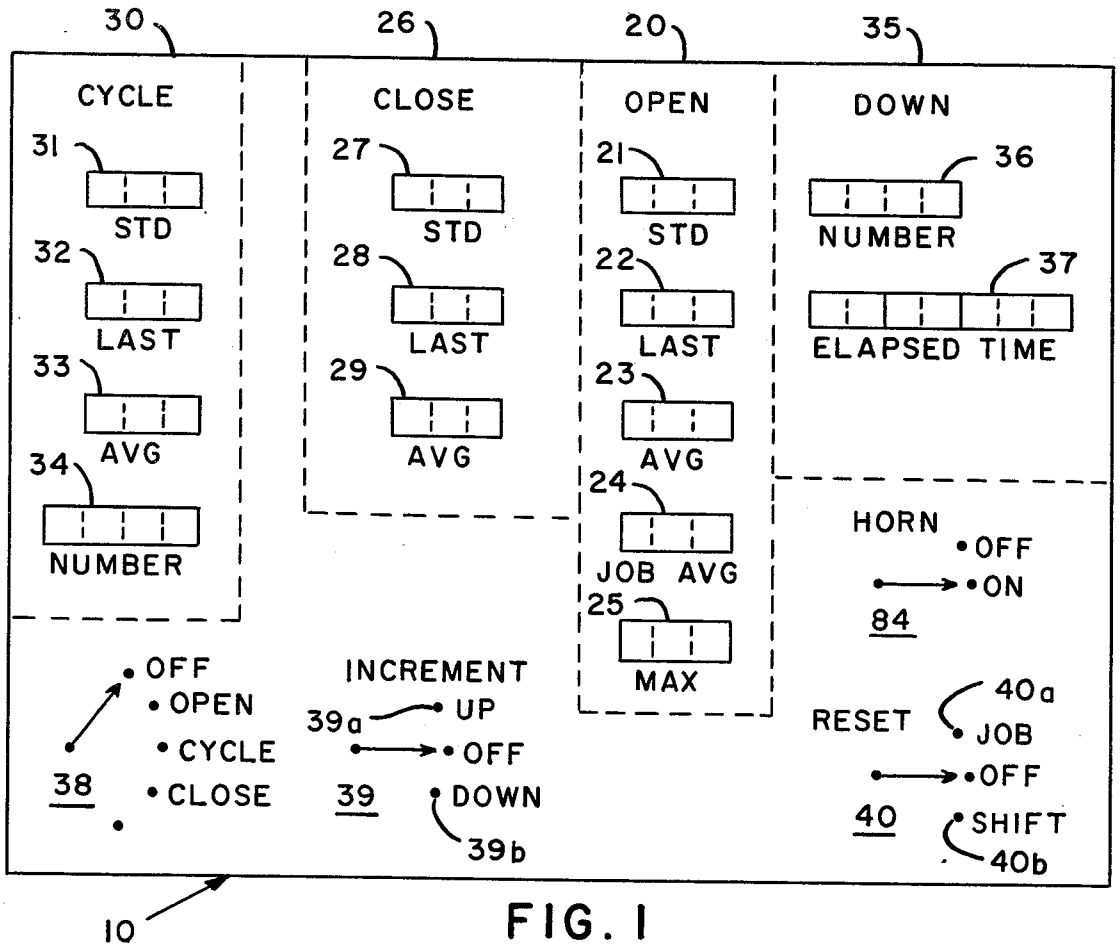
FIG. 1 is a front view of the measuring and display unit of the present invention.

In FIG. 1, information of the durations of the open step are located in the display unit 10 within a dotted line block 20 denoted "OPEN" and includes a first readout 21 which is set to display the standard duration of the open step and under which there is the notation "STD." The next readout 22 displays the duration of the open step for the last cycle while a readout 23 displays the average of the open step durations from the beginning of a work period, such as the beginning of the work shift. The next readout 24 displays the average of the open step durations since the initiation of the work cycle and thus is the average time for all operators to perform the open step. The lowest readout 25 displays the maximum duration of the open step that is counted into the average shown in readouts 23 and 24 with the excess thereover not being included in determining the average open steps. The notation "LAST" preferably appears under readout 22, "AVG" under readout 23, "JOB AVG" under readout 24 and "MAX" under readout 25.

Within a dotted line block 26 of the unit 10 denoted "CLOSE," there is provided three readouts 27, 28 and 29 for the close step with the first readout 27 being set to the duration of the standard close time which has been found in prior operations of the cycle to produce a satisfactory article while readout 28 indicates the duration of the last close step. Readout 29 displays the average of the close step durations from the beginning of the work period. As with the block 20, notations of "STD," "LAST" and "AVG" appear under readouts 27, 28 and 29, respectively.

Further information with respect to the operation of the molding machine is displayed within a dotted line block 30 denoted "CYCLE" and includes a readout 31 in which is displayed the standard time for a complete work cycle, a readout 32 which displays the duration of the last work cycle and a readout 33 which displays the average duration of complete cycles since the beginning of the work period. Again, notations of "STD," "LAST" and "AVG" appear under their respective readouts. A further readout 34 dsplays the number of cycles since being reset for the work period and has the notation "NUMBER" thereunder.

The unit 10 further measures and displays the number of times that the open step exceeds the maximum set in the readout 25 together with the accumulated durations of these excesses to provide to an operator or management the amount of time that the machine is not functioning. Accordingly, within a block 35, denoted "DOWN," there is provided a readout 36 which counts each excessive open step and a readout 37 which displays the accumulated durations of the excess periods. The former has the notation "INCIDENTS" thereunder while the latter has the notation "ELAPSED TIME" under the readout 37.

The fixed number readouts 21, 25, 27 and 31 are preferably set to their values by a selection switch 38 together with an incrementing switch 39. By placing the switch 38 at one of the indicated positions, the readout associated therewith may have a desired number displayed by operation of the incrementing switch 39 to either contact 39*a* for increasing the readout count or contact 39*b* for decreasing the readout count. A RESET switch 40, which is preferably key operated, is utilized at the end of the complete work cycle when engaging job contact 40*a* to clear readouts 21, 24, 25, 27 and 31 while when set to engage the shift contact 40*b*, the remaining readouts are cleared to zero at the end of an operator's work period or shift. As will be apparent, a different arrangement of clearing the resets may be employed, as for example, clearing readouts 36 and 37 at the end of the job rather than at the end of each work period.

In each of the readouts, each numeral may be an LED display such as a type 367 available from Fairchild Instruments which provides display numerals on the order of ⅜ of an inch in height for facilitating reading thereof. With the exception of readouts 34, 36 and 37, all readouts display time by having three digits with the first two digits indicating time in seconds and the last digit, in tenths of a second. The readouts 34 and 36 display decimal digit whole numbers while the readout 37 displays accumulated time in hours, minutes and seconds, including tenths thereof. Other than the mounting of the measuring and display unit 10 together with providing switches S1', S2' and S3' when needed, no other changes are required in the machine 11 and it performs in its normal manner. The switches are of the N.O. snap action type.

Figure 4:
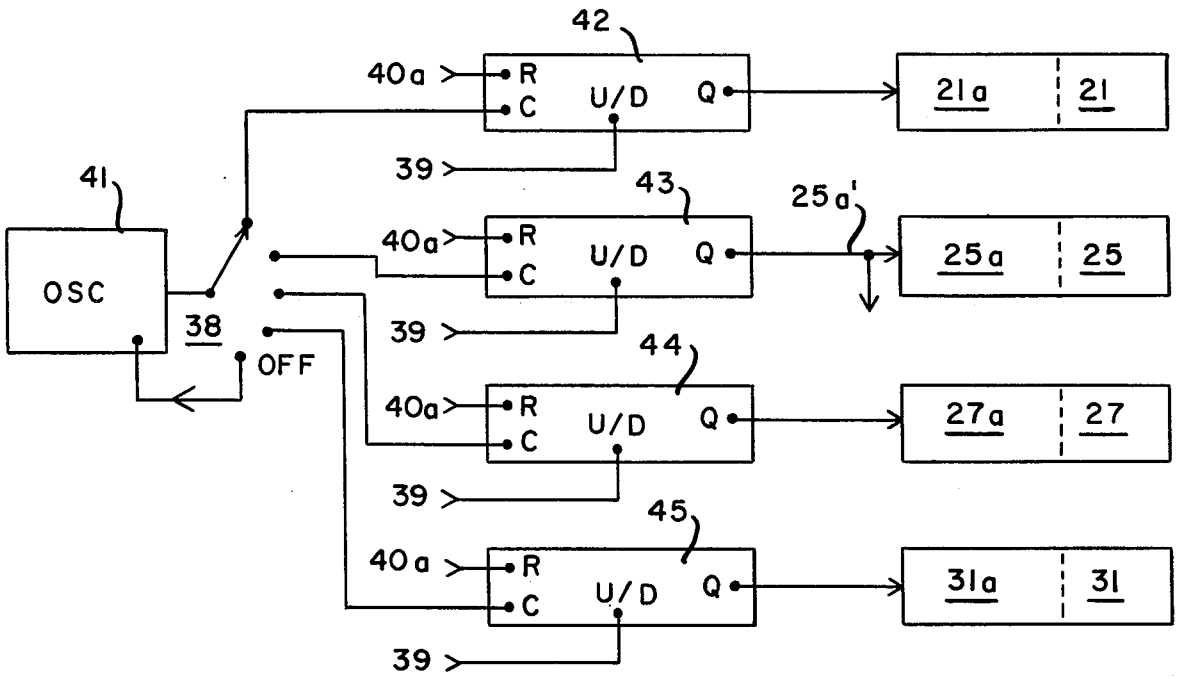
FIGS. 4–4D are an electrical schematic diagram of the circuits of the unit for setting display standards (4) and producing information for the close step (4A), the open step (4B), the total work cycle (4C) and the non-operating time (4D) of the machine.
Figure 4A:
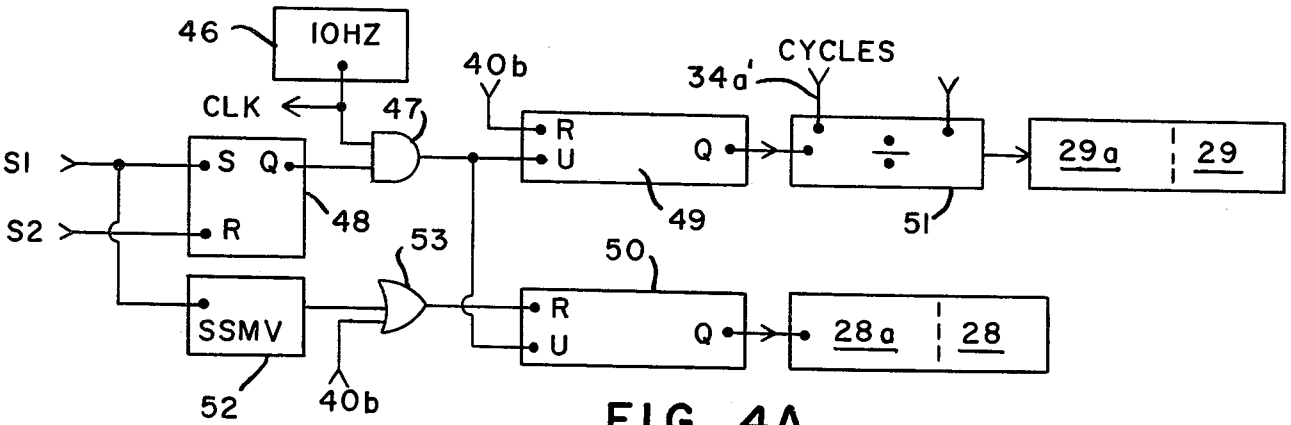
Figure 4B:
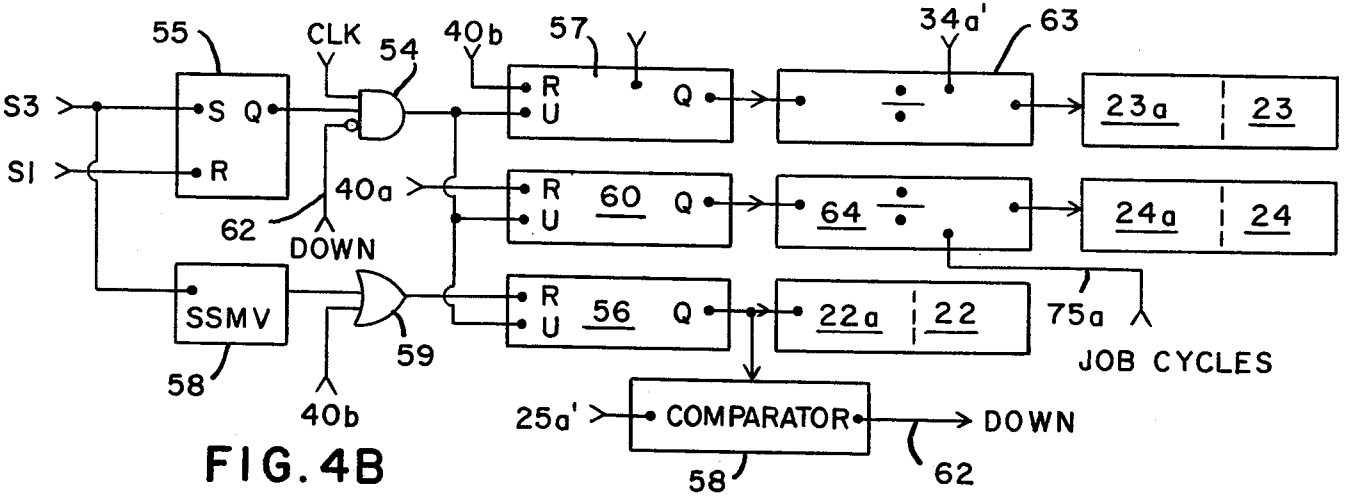
Figure 4C:
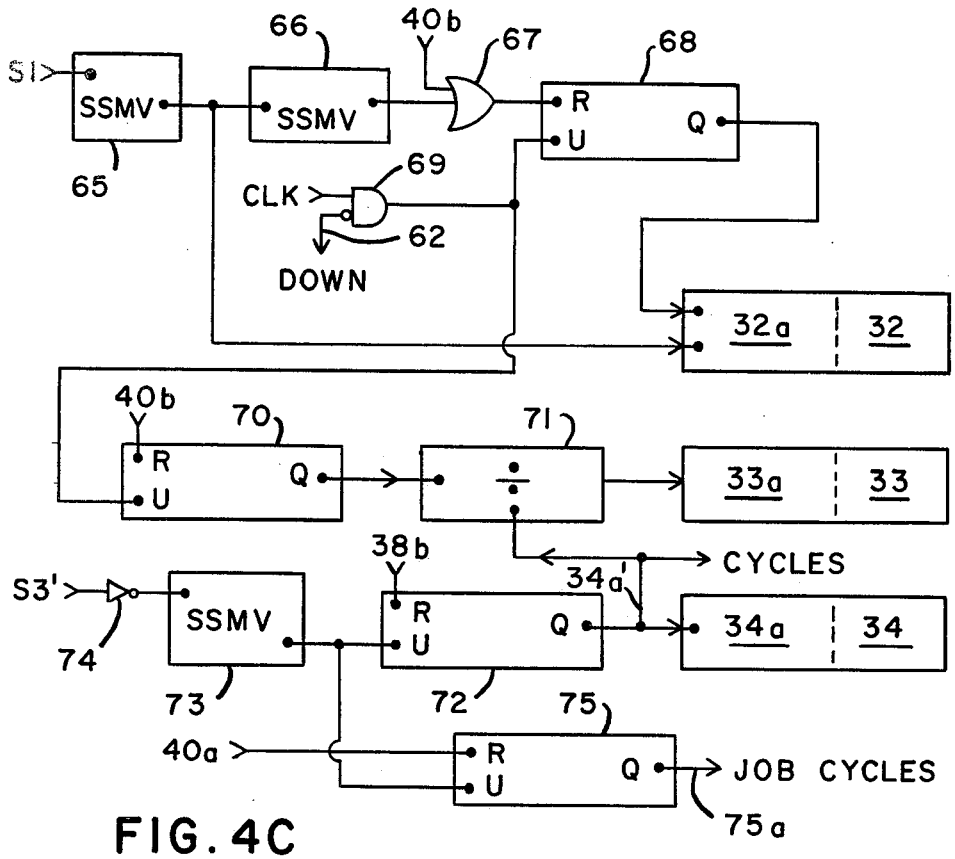
Figure 4D:
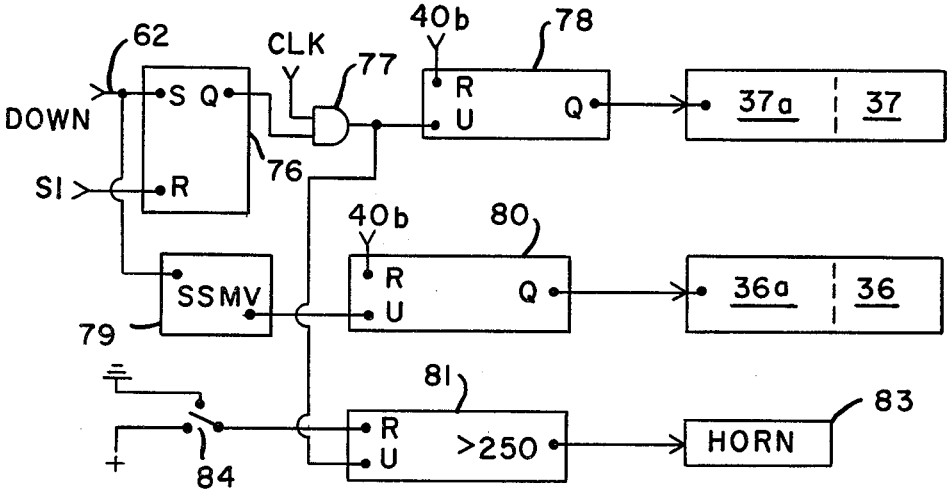

Shown in FIGS. 4–4D are the electrical circuits for using the heretofore mentioned switches and signals to control appropriate readouts. Referring to FIG. 4, the circuit for setting the fixed number displays includes an adjustable rate oscillator 41 which produces incrementing pulses that are directed to the contact arm of the selecting switch 36 and in the solid line position shown are received at an incrementing terminal (C) of a counter 42. The counter 42 has an U/D terminal which is connected to the switch 39 for controlling the direction of count of the counter. The count of the counter is directed to a BCD to 7 segment/latch/decoder driver 21*a* that is connected to illuminate the readout 21 to display the count of the counter 42. There is a counter 42 (which may be an integrated circuit type 4510B) and a driver decoder (which may be a type 4511B) for each numeral in the readout. The counter 42 has a reset to zero terminal (R) which is connected to receive a reset command upon movement of the reset switch 40 to engage contact 40*a*.

Similarly, the readout 25 has a decoder driver 25*a* and a counter 43, the readout 27, a driver 27*a* and a counter 44 and the readout 31, a driver 31*a* and a counter 45. It is noted that the count of counter 42 is also present on a lead 25*a*' which is utilized in the open circuit shown in FIG. 4B. As shown, the reset terminals (R) of the counters 43, 44 and 45 are connected to the reset switch contact 40*a*.

Shown in FIG. 4A is the circuit for measuring the close step information displayed in readouts 28 and 29. An oscillator 46, operating at 10 Hz to provide a pulse every tenth of a second, is connected to supply CLK pulses to one input of an AND gate 47 whose other input is connected to the Q terminal of a flip-flop 48. The set terminal of the flip-flop is connected to receive the S1 signal while the reset terminal thereof is connected to receive the S2 signal. Upon an S1 signal appearing, the gate 47 permits the CLK pulses to pass to the incrementing up (U) terminal of a counter 49 and also to the incrementing up terminal of a counter 50. The counter 50 counts the CLK pulses and its count is directed to a driver 28*a* connected to operate the close last readout 28. The count of the counter 49, which is functioning to accumulate the total last durations is directed to a divider 51, which also receives information on a cycle number lead 34*a*' and which by dividing the former by the latter, produces the average thereof to a driver 29*a* for the close average readout 29.

The close step terminates with the appearance of the signal S2 which causes the terminal Q of the flip-flop 46 to assume a zero logic level and thereby inhibit the passing of further CLK pulses to the counters 49 and 50. The readouts 28 and 29 will display their duration information until the next S1 signal appears when readout 28 is reset to zero by way of a single shot multi-vibrator 52 producing through an OR gate 53 a signal to the reset terminal of the counter 50. The other input to the OR gate 53 is the signal caused by operation of the switch to contact 40*b*, which is also connected to the reset terminal of counter 49, to enable resetting these counters to zero at the end of a work period.

Shown in FIG. 4B is a similar circuit for providing information of durations to control the open last readout 22, the open average readout 23 and the open job average readout 24, each of which has associated therewith a driver decoder 22*a*, 23*a* and 24*a*, respectively. Clock pulses on the CLK lead constitute one input of an AND gate which has another input connected to the Q terminal of a flip-flop 55 with the latter receiving the signal S3 at its S terminal and the signal S1 at its R terminal and a third input connected to receive an inverted DOWN signal. Upon reception of the S3 signal, the gate 54 permits CLK pulses to pass to the increment up terminals of counters 56 and 57 to increment each with each pulse provided a down condition does not exist. The pulses continue until the appearance of the S1 signal which resets the flip-flop 55 to inhibit the passing of pulses by gate 54 until the next S3 signal appears. The counter 56 is reset by operation of a single shot multivibrator 58 by the S3 signal through an OR gate 59 to the R terminal thereof. In addition, the switch contact 40*b* constituting another input to the OR gate 59, may reset the counter 56 through the gate and the counter 57 directly when operated.

Also receiving the CLK pulses from the gate 54 is a counter 60 which is reset by job switch contact 40*a* so that it accumulates the total time from the beginning of the job for the open step.

The count of the counter 56 is also directed to a comparator 61 which receives a signal on a lead 25*a*' representing the MAX count to which the readout 25 is set. Upon the count of counter 56 equaling the MAX count displayed in readout 25, a down signal is produced on a DOWN lead 62. The DOWN signal is also supplied, though inverted, as an input to the AND gate 54 and upon the appearance of the DOWN signal, the gate 54 inhibits further CLK pulses from passing into counters 56, 57 and 60. This stoppage prevents penalization of the operator act should the duration of the open step exceed the MAX set duration as such an excess is generally beyond the operator's control.

As in the close circuit, the information for the average display 23 is obtained by a divider 63 that receives information of the number of cycles on the lead 34*a'* and the count of the accumulating counter 57 and divides the latter by the former. Similarly, a divider 64 receives the accumulated job duration from the counter 60 together with the number of job cycles on a lead denoted "JOB CYCLES," and by dividing the former by the latter, produces the average job open step displayed in the readout 24.

Shown in FIG. 4C is a circuit for providing the information to the cycle last readout 32, the cycle average readout 33, the number of cycles readout 34 and accumulating the number of job cycles. The signal S1 is introduced to a single shot multi-vibrator 65 which in turn actuates another multi-vibrator 66, the output of which consititutes one input to an OR gate 67, the other input being from reset switch contact 40*b*. The output of the OR gate 67 is connected to the reset terminal of a counter 68. The incrementing terminal (U) of the counter 68 is connected to the output of an AND gate 69 which receives on one input the CLK pulses and on the other, an inverted DOWN signal from the lead 62. The output of the counter 68 is directed to a decoder driver 32*a* associated with the readout 32. In addition, the CLK pulses thorugh the gate 69 are directed to the incrementing (U) terminal of another counter 70 whose output constitutes one input to a divider 71 whose output in turn is directed to a decoder driver 33*a* of the cycle average readout 33.

The other input to the divider 71 is obtained from the output of a counter 72 on the lead 34*a'* which counts the number of cycles caused by the actuation of a multivibrator 73 which in turn is actuated each time the signal S3' is removed by reason of an inverter 74. The cycle number readout 34 also receives the output of the counter 72 through a driver decoder 34*a*. A counter 75 also receives the output of the multi-vibrator 73 and as it is reset by job switch contact 40*a* it accumulates the number of cycles in the job and supplies this count on the lead 25*a* denoted "JOB CYCLES" to the divider 64. If desired, a job number readout may be provided.

In the operation of the cycle circuit, the multi-vibrator 65 provides a momentary pulse to the decoder 32*a* to cause it to assume the count of the counter 68 and then subsequently actuates the multi-vibrator 66 to reset the counter 68 with the decoder 32*a* storing the last count of the counter 68 for the cycle last readout 32. Clock pulses are then counted (assuming a DOWN signal is not present) by both the counters 68 and 70 until the next S1 signal appears. The removal of the S3' (or S3 if it continues to the end of the open step) signal which occurs at the end of each cycle, increments the counter 72 to maintain a count of the number of cycles which is directed to the readout 34 and also provides on the lead 34*a'* denoted "cycles," the same information to the open step divider 63 and the close step divider 51. It will be noted that if the open time exceeds the maximum set by the MAX readout 25, such a duration is not included in the cycle average time or added into the total of the cycle times kept by the counter 70 as the gate 69 will inhibit the passing of pulses. Counters 68, 70 and 72 have their reset terminals connected to the switch contact 40*b* for resetting at the end of each work period.

The down circuit as shown in FIG. 4D accepts the DOWN signal on the lead 62 and applied it to the S terminal of a flip-flop 76 while the S1 signal is applied to the reset terminal thereof. The output of the flip-flop 76 is directed as one input to an AND gate 77 which also receives CLK pulses on its other input, and the output of the gate 77 is directed to the incrementing up (U) terminal of a counter 78. The output of the latter is connected to a decoder driver 37*a* which controls the elapsed down time readout 37. It will be appreciated that the counter 78 constitutes a plurality of counters that are cascaded in a manner such that they count in hours, minutes and seconds. The down signal on the lead 62 is also directed to a single shot multi-vibrator 79 whose output is connected to the increment up (U) terminal of a counter 80 having an output terminal connected to a decoder driver 36*a* of the incident readout 36. Accordingly, upon the presence of a down signal, not only would the time after the occurrence of the down signal not be counted in determining the average and job open readouts 23 and 24, but it would be accumulated by the counter 78 to be displayed by the readout 37 and the number of times that a down incident occurs would be counted by the counter 80 to be displayed by the readout 36.

The reset terminals of the counters 78 and 80 are shown connected to the switch contact 40*b* to be cleared at the end of each work period. If desired, they may instead be connected to the switch contact 40*a* to be cleared at the end of the job.

It has been found desirable to provide a perceptible event such as an attention obtaining operation of a horn in order to positively alert the management that a down status for the machine exists and that it requires attention. Moreover, in order to maintain management's rapid repsonse to the occurrence of such an event, it should not occur simultaneously with the down signal. Accordingly, the unit of the present invention includes a counter 81 which is set to provide a signal on a lead 82 to a horn 83, a determined duration after a down occurrence has commenced. In the embodiment shown, the duration is set at 25 seconds by the counter 81 providing the signal when its count exceeds 250. The counter 81 may be reset and the horn deactivated by managemement's operation of a switch 84 which for convenience, is located adjacent the reset switch 40 on the unit.

The measuring and display of the open step last with the average operator's and job duration has appeared to motivate an operator to decrease the time required for the operator's act. This motivation may be attributed to a self-competitive spirit of an operator in comparison of the duration of each open step against the operator's own average with the natural desire not to increase the average by a slow performance while providing an instant "reward" (i.e. a low last time) for an extremely efficient performance of the last step. In addition, a group competitive spirit may further motivate the operator by a desire not to have durations which exceed the average job duration together with a comparison of averages between operators.

In one instance, a molding operation which was estimated to require a 12-second open step time and was initially typically being performed in 7 seconds when the unit 10 was installed. When the standard duration set forth in readout 21 was changed from 12 to 7 seconds, and an incentive program established, some operators increased their efficiency to provide an average duration on the order of 3 seconds, thereby substantially reducing the work cycle time of the machine. Moreover, as the piecework rates were not substantially changed, the increased efficiency seemed to be almost completely tracable to the unit 10 rather than to a monetary incentive.

In addition to being able to motivate the operators in the operation of other types of machines having an operator act, the present unit has been found extremely advantageous in setting up a machine to perform a work cycle that had been previously performed and for which satisfactory operating times had been established. Such a repetition may occur in a molding machine where a mold die had been previously employed to produce parts, then different dies installed for other parts, and then the one mold die is repositioned in the machine to make more of the one parts. The machine may then be adjusted to provide the close time that was found satisfactory and also the clamp time so that the work cycle times become the same as previously. Moreover, the operator may be made aware of the typical value of the open duration so that the machine may be easily set to duplicate prior satisfactory performance with a minimum of trial and error. The present unit may also be used to duplicate prior performance even when the duration of the operator's act is relatively insignificant or in fact not present at all. Moreover, with the measuring and display unit of the present invention being installed, there appeared to be fewer rejects in a molding operation as the operator act tended to have a relatively constant duration which permitted "fine tuning" of the machine and consequently fewer rejects.

It will accordingly be understood that there has been disclosed a measuring and display unit that is capable of both motivating an operator to increase the operator's efficiency in performing an operator act and which also facilitates duplicating prior satisfactory machine performance. The unit displays to the operator the just completed and average operator's and job durations of a step in a work cycle which includes the operator act and each operator tends to perform in a manner which reduces the time required for its performance. Moreover, by limiting the operator act step to a maximum duration, an operator act average time is prevented from being adversely increased by events that tend to be outside the operator's control. As the work cycle has more than one step, the unit by providing information of the last and average durations of at least another step together with similar durations for the complete cycle facilitates repeating prior satisfactory operating durations with a minimum of error while motivating other individuals such as foremen and set-up men to achieve the prior satisfactory operation each time the job is initiated.

Variations and modifications may be made within the scope of the claims and portions of the improvements may be used without others.

I claim:

1. A measuring and display unit for use with a machine performing a repeating work cycle having a plurality of steps with the one of the steps being an operator step including an operator act and with the duration of the operator step being varied by the operator's performance, comprising means for providing a signal at the initiation of the operator step means for providing a signal at the end of the operator step, means for measuring and displaying the numerical value of the last duration between the two signals for each cycle, and means for displaying the numerical value of at least one previous duration between the two signals for each cycle representative of the duration of an identical previous operator step or average of identical previous operator steps, said last and previous display means being located near the area occupied by the operator to facilitate observation of the displayed durations by the operator and comparision of the duration of the just completed operator step with the duration of an identical previously completed operator step or with the average duration of identical previously completed work steps.

2. The invention as defined in claim 1 in which there are means for determining the numerical value of the average last duration of identical previous operator steps for a plurality of work cycles for the same operator and displaying the average duration adjacent the last display means whereby an operator may easily compare the two numerical values of the durations.

3. The invention as defined in claim 1 in which there are means for determining the numerical value of the job average duration of the operator step for a plurality of work cycles by different operators and displaying the job duration average adjacent the last display means whereby an operator may easily compare the two numerical values of the durations.

4. The invention as defined in claim 1 in which there are means for setting and displaying the numerical value of a maximum duration of the operator step and means interconnected with the means for measuring the last duration to prevent the measuring of a last duration having a value greater than the maximum duration.

5. The invention as defined in claim 4 in which the means for preventing the measuring of a last duration having a value greater than the maximum duration includes the preventing of adding a value greater than the maximum value to an average last duration and an average job duration.

6. The invention as defined in claim 4 in which there are means for measuring and displaying the number of times that the duration of the operator step exceeds the maximum duration.

7. The invention as defined in claim 6 in which there are means for measuring and displaying the sum of the durations of the operator step that exceed the maximum duration.

8. The invention as defined in claim 4 in which there are means for providing a perceptible event upon receipt of a signal and means for providing a signal when the duration of the one step exceeds a set duration greater than the maximum duration.

9. The invention as defined in claim 1 in which there are means for setting and displaying a numerical value of a standard duration for the operator step located adjacent to the means for displaying the numerical value of the duration of the last operator step.

10. The invention as defined in claim 1 in which the measuring and display unit includes means for measuring and displaying the duration of the numerical value of another step in each work cycle.

11. The invention as defined in claim 10 in which the measuring and display unit includes means for determining the numerical value of the average duration of the another step for a plurality of work cycles and displaying said average duration.

12. The invention as defined in claim 1 in which the measuring and display unit includes means for measuring and displaying the numerical value of duration of each work cycle.

13. The invention as defined in claim 12 in which the measuring and display unit includes means for determining the numerical value of the average duration of each work cycle for a plurality of work cycles and displaying said average duration.

14. The invention as defined in claim 12 in which there are means for setting and displaying the numerical value of a standard duration for the work cycle adjacent to the means for measuring and displaying the duration of each work cycle.

15. A measuring and display unit for use with a plastic injection molding machine having at least an open and a closed step in a work cycle for producing an article comprising means for measuring and displaying a numerical value of the durations of each of the open and closed steps and complete work cycle for a just completed work cycle, means for determining and displaying the numerical values of the average durations of each of the open and close steps and the complete work cycle for a plurality of work cycles, means for measuring and displaying the number of identical work cycles, and settable means for displaying the numerical value of standard durations for each of the open and closed steps and complete work cycle.

16. The invention as defined in claim 15 in which there are settable means for setting a numerical value of the maximum duration of the open step, means for measuring and displaying the number of times that the duration of the open step exceeds the maximum duration and means for measuring and displaying the total duration of the open step that exceeds the maximum duration.

17. The invention as defined in claim 15 in which there are settable means for setting a numerical value of the maximum duration of the open step, means for determining and displaying a numerical value of the average job duration of the open step for a different plurality of work cycles than said first mentioned plurality and means for preventing a value of an open step duration to exceed the maximum value in determining both average durations of the open step.

* * * * *

UNITED STATES PATENT AND TRADEMARK OFFICE

CERTIFICATE OF CORRECTION

PATENT NO. : 4,256,953

DATED March 17, 1981

INVENTOR(S) : Paul E. Allen

It is certified that error appears in the above-identified patent and that said Letters Patent are hereby corrected as shown below:

Col. 1, line 58, after the term "operator", insert the phrase --so that an operator--; col. 2, line 6, "stop-pages" should be --stoppages--; col. 2, line 7, "operator'" should be --operator's"; col. 2, line 53, "substraction" should be --subtraction--; col. 3, line 25, "and" should be --an--; col. 3, line 29, "switcch" should be --switch--; col. 4, line 54, "dsplays" should be --displays--; col. 7, line 26, "thorugh" should be --through--; col. 7, line 66, "applied" should be --applies--; col. 8, line 33, "repsonse" should be --response--; col. 10, line 46, "one" should be --operator--; col. 11, line 17, before the term "work", insert the term --identical--.

Signed and Sealed this

*Second* Day of *June 1981*

[SEAL]

*Attest:*

RENE D. TEGTMEYER

*Attesting Officer*

*Acting Commissioner of Patents and Trademarks*